US006962272B2

(12) United States Patent
LeBlond

(10) Patent No.: US 6,962,272 B2
(45) Date of Patent: Nov. 8, 2005

(54) SURFACE MOUNTED DISPENSING SYSTEM

(75) Inventor: Claude W. LeBlond, Irvine, CA (US)

(73) Assignee: Gerenraich Family Trust, Laguna Hills, CA (US)

( * ) Notice: Subject to any disclaimer, the term of this patent is extended or adjusted under 35 U.S.C. 154(b) by 82 days.

(21) Appl. No.: 10/783,605

(22) Filed: Feb. 20, 2004

(65) Prior Publication Data

US 2005/0184097 A1 Aug. 25, 2005

(51) Int. Cl.[7] ..... B67D 5/42
(52) U.S. Cl. ..... 222/180; 222/181.3; 222/321.9; 215/399; 220/481; 220/751
(58) Field of Search ..... 222/180, 181.2, 222/181.3, 321.1, 321.7, 321.9; 215/395, 215/399; 220/480, 481, 751

(56) References Cited

U.S. PATENT DOCUMENTS 1,455,970 A * 5/1923 Resek ..... 222/181.2
3,920,164 A * 11/1975 Lindsoe ..... 222/180
3,990,611 A * 11/1976 Sojka ..... 222/180
4,166,553 A * 9/1979 Fraterrigo ..... 222/181.2
5,632,418 A * 5/1997 Brown ..... 222/180
6,092,694 A * 7/2000 Sadow ..... 222/180
6,805,264 B2 * 10/2004 Houvras ..... 222/180
6,808,090 B2 * 10/2004 Pedersen ..... 222/181.3
6,910,604 B2 * 6/2005 Gugliotti et al. ..... 222/179.5
2002/0074356 A1 * 6/2002 Lewis et al. ..... 222/181.3

* cited by examiner

*Primary Examiner*—Kenneth Bomberg
(74) *Attorney, Agent, or Firm*—Walter A. Hackler

(57) ABSTRACT

A surface mounted dispensing system includes a bracket having a circular flange and a central hub protruding therefrom with a hub including threads thereon. A bottle is providing having a flat back with a circular embossment for receiving the flange and the hub. The embossment includes a depth for enabling the flat back to flushly contact a surface supporting the flange. The embossment includes a grooved central recess for engaging a hub in order that rotation of the bottle in one direction causes the bottle to be secured to the bracket and rotation in an opposite direction causes release of the bottle from the bracket.

15 Claims, 1 Drawing Sheet

SURFACE MOUNTED DISPENSING SYSTEM

The present invention is generally related to surface or wall mounted dispensers suitable for measuring and delivering into a users hand a small uniform quantity of liquids or viscous liquids such as soaps, creams, paste and lubricants.

Many designs of liquid dispensers, particularly liquid soap dispensers, are well known in the art. Such dispensers typically are employed in public restrooms and the like and usually include a mounting bracket to permanently affix the dispenser to a wall. Such dispensers also include an access port of same type in order that the dispenser may be serviced by a maintenance worker for refilling.

Other types of dispensers utilize refill cartridges that are inserted into a housing structure. All such dispensers rely on continued maintenance and operability of the housing, which is permeably affixed to a wall.

In order to service such dispensers, a supply system must be utilized for storing additional liquid soap or the like which is thereafter transported and loaded into the dispenser. It should be apparent that this maintenance entails considerable time and logistics.

In addition, if the dispenser is damaged or vandalized, replacement thereof involves the removal of the entire housing from the wall and the reinstallation of a new dispenser housing.

The present invention is an improvement over such existing dispensers in that it provides a self-contained dispenser, which may be disposable or refillable. The refilling of the dispenser may be done in a central location and accordingly does not depend upon the time consuming onsite refilling of heretofore utilized wall-mounted dispensers.

SUMMARY OF THE INVENTION

A surface mounted dispensing system in accordance with the present invention provides for a flush mounted bottle and bracket with the dispensing bottle being easily removed from the bracket.

More particularly, the bracket includes a mounting flange and a threadable hub upstanding from the flange. The bottle, in turn, includes a flat back with an embossment for receiving the hub and the flange in order to enable the flat back to flushly contact a surface supporting the bracket.

This structure inhibits tampering of the dispensing bottle in view of the fact that there is no members which are accessible to vandals.

More particularly, the embossment includes a grooved central recess for engaging a threaded hub which enables rotation of the bottle with the respect to the bracket to secure and release the bottle to and from the bracket.

Thus, for maintenance requiring refilling of the bottle, a maintenance worker may simply replace the empty or partially full dispenser bottle with a full bottle with minimal effort. The empty or partially full bottles may thereafter be reloaded at a central site. Accordingly, the present invention may include a system which includes a plurality of bottles and a bracket for supporting one of the bottles with the remaining bottles being utilized for on-site refilling.

Preferably, the hub threads and corresponding recess grooves are left-handed which is contrary to convention so that instinctual clockwise rotation of the bottle with respect to the bracket actually tightens the bottle to the bracket. Because of the flush mount, no other visible means of attachment are evident which enhances the tamper proof nature of the surface mounted dispensing system in accordance with the present invention.

Still more particularly, the mounting flange may include slots for receiving headed screws for fixing the bracket to the surface. Such screw heads are accommodated by the embossment which includes a circular groove surrounding the central recess for receiving the screw heads which also enables and facilitates the flat back to flushly contact the monthly surface and further enables rotation for securing and releasing the bottle to and from the bracket.

A plunger type dispenser is disposed at a top of the bottle along an axis dissecting the central recess. This structure enables actuation of the plunger so that no rotation or torque to the bottle is provided and hence dislodgement of the bottle from the bracket is inhibited. In a preferred embodiment of the present invention, both the flange and the recess are generally circular in nature.

BRIEF DESCRIPTION OF THE DRAWINGS

The advantages and features of the present invention will be better understood by the following description when considered in conjunction with the accompanying drawings in which.

DETAILED DESCRIPTION

Figure 1:
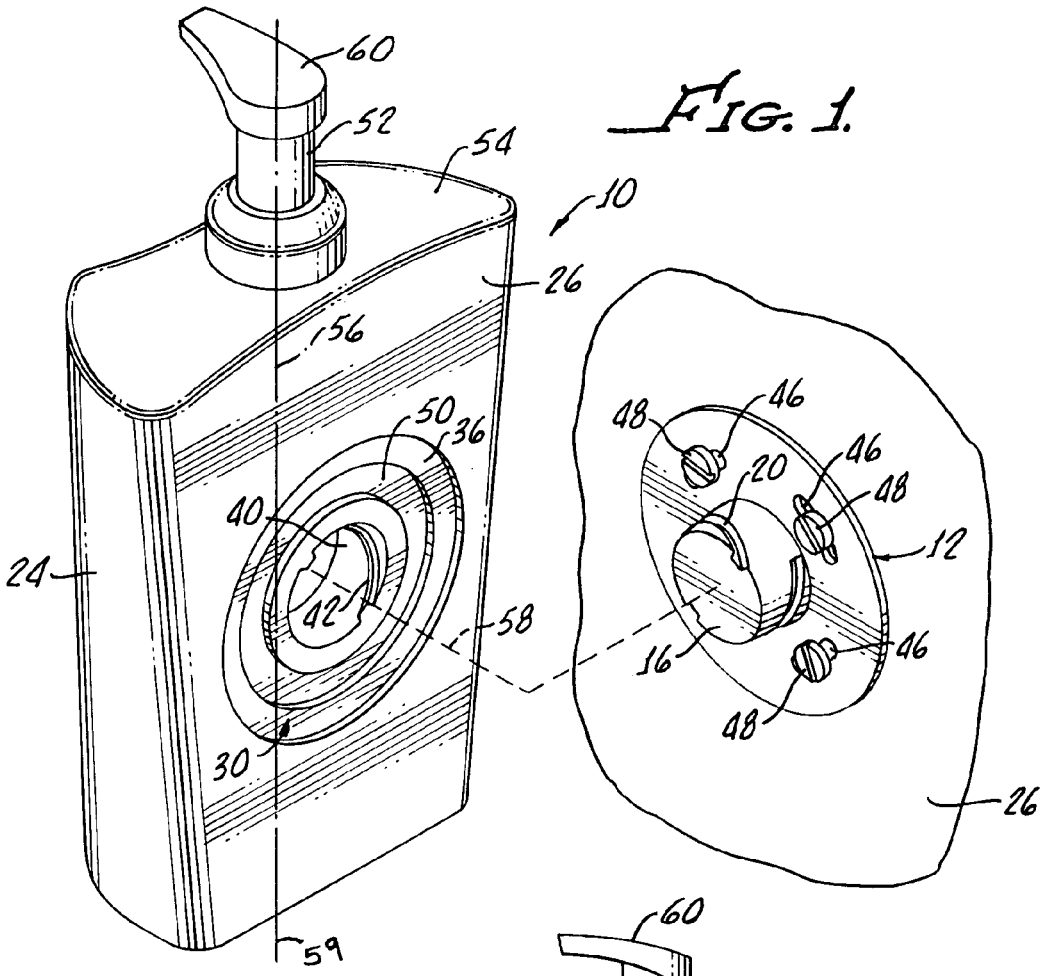
FIG. 1 is a perspective view of the bottle and bracket in accordance with the present invention showing the bottle and the bracket in a spaced apart relationship in order to show a bracket flange, a bracket hub along with a bottle having a flat back with an embossment therein for receiving the bracket hub.
Figure 2:
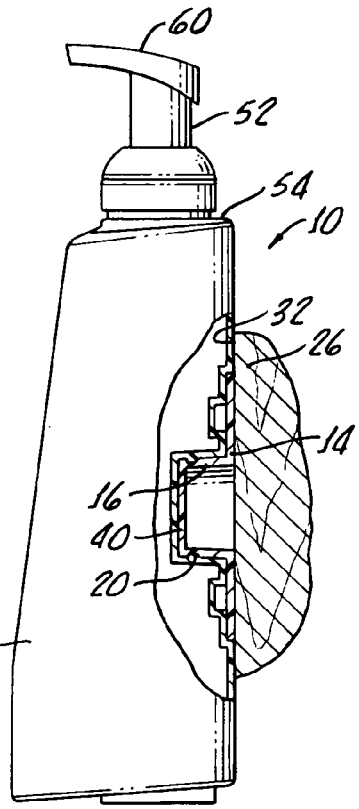
FIG. 2 is a side view of the bottle and bracket of FIG. 1, in partial cross section, showing the engagement of the embossment with the bracket and flush mounting of the flat back of the bottle against a mounting surface.

With reference to FIGS. 1 and 2, there is shown a surface mounting dispensing system 10 generally including a bracket 12 having a circular flange 14 and a central hub protruding, or upstanding, therefrom.

As shown, the hub 16 includes threads, preferably left-handed as hereinabove noted, formed therein. A bottle 24 in accordance with the present invention includes a generally flat back 26 with a circular embossment therein for receiving the flange 14 and the hub 16.

As more clearly shown in FIG. 2, the embossment 30 has a depth for receiving the hub 16 and flange 14 to enable the flat back 26 to flushly contact a surface 26, 32 supporting the bracket 14.

The embossment 30 includes an outer recess 36 for receiving the flange 14 and a central recess 40 for receiving the hub 16. Preferably molded into the central recess 40 are threads 40 for engaging grooves 20 of the hub 16. Preferably, the grooves 16, threads 40 engagement is of rapid disconnect for enabling a 180° rotation of the bottle 24 to completely disengage from the flange or engage the flange by a half turn.

Preferably, the bottle is blow molded from plastic and the bracket may either be plastic or metal. Any suitable material may be utilized.

The mounting flange 14 may include slots 46 enabling fixing of the bracket 14 to the surface 32 through the use of headed screws 48. The headed screws 48 are accommodated by a second recess 50 in the embossment 30 which enables the flush mount of the bottle 24 against a surface 26, as illustrated in FIG. 2.

Preferably, the flange 14 and embossment 30 are generally circular in nature which facilitates manufacture and the rotation of the bottle 24 with respect to the bracket 14.

A dispensing pump 52 which, may be conventional in nature, is disposed at a top 54 of the bottle 24 on an axis 56 which is perpendicular to an embossment axis 58 and thus dissects the central axis 59 in order that actuation of a dispenser plunger 60 does not apply any rotational torque to the bottle 24. This prevents dislodgement of the bottle 24 from the bracket 14 during operation of the dispenser 52.

Although there has been hereinabove described a specific surface mounted dispensing system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A flush mount dispensing bottle and bracket comprising:

a bracket having a mounting flange and a threaded hub, upstanding from the flange; and a bottle having a flat back with an embossment for receiving the hub and the flange to enable the flat back to flushly contact a surface supporting said bracket, said embossment including a grooved central recess for engaging said threaded hub for enabling rotation of said bottle, with respect to said bracket, to secure and release said bottle to and from said bracket.

2. The bottle and bracket according to claim 1 wherein said mounting flange includes slots for receiving threaded screws for fixing said bracket to said surface, and said embossment includes a circular groove surrounding the central recess for receiving the screw heads to both enable the flat back to flushly contact the surface and rotate to cause securing and releasing said bottle to and from said bracket.

3. The bottle and bracket according to claim 1 wherein the hub threads and central recess threads are left-handed to enable clockwise rotation of said bottle with respect to said bracket to release said bottle from said bracket.

4. The bottle and bracket according to claim 1 further comprising a plunger type dispenser disposed at a top of said bottle along an axis dissecting the central recess in order that actuation of said plunger does not apply any rotation torque to the bottle thus preventing dislodgement of said bottle from said bracket.

5. The bottle and bracket according to claim 2 wherein said mounting flange is circular.

6. The bottle and bracket according to claim 5 wherein said embossment is circular.

7. The bottle and bracket according to claim 1 wherein the threads and grooves enable engagement and disengagement of the bottle to and from the bracket by a 90° rotation of the bottle.

8. A surface mounted dispensing system:

a bracket having a circular flange and a central hub protruding therefrom, the hub having threads therein;

a bottle having a flat back with a circular embossment for receiving the flange and the hub, the embossment having a depth for enabling the flat back to flushly contact a surface supporting the flange, said embossment including a grooved central recess for engaging the hub threads, rotation of said bottle in one direction causing the bottle to be secured on said bracket and rotation is an opposite direction causing release of the bottle from said bracket.

9. The system according to claim 8 wherein said circular flange includes slots for receiving headed screws for fixing said bracket to said surface, and said embossment includes a circular groove surrounding the central recess for receiving the screw heads both enable the flat back to flushly contact the surface and rotate for securing and releasing said bottle to and from said bracket.

10. The system according to claim 8 wherein the hub threads and central recess grooves are left-handed to enable clockwise rotation of said bottle with respect to said bracket to release said bottle from said bracket.

11. The system according to claim 8 further comprising a plunger type dispenser disposed at a top of said bottle along an axis dissecting the central recess in order that actuation of said plunger does not apply any rotation torque to the bottle thus preventing dislodgement of said bottle from said bracket.

12. The system according to claim 8 wherein said embossment is circular.

13. The system according to claim 8 further comprises a plurality of the bottles each removably fixable to said bracket.

14. The system according to claim 8 wherein the thread and grooves enable engagement and disengagement of the bottle to and from the bracket by a rotation of the bottle.

15. The system according to claim 14 wherein the rotation is 180°.

* * * * *